US005826355A

United States Patent [19]

Vaccari

[11] Patent Number: 5,826,355

[45] Date of Patent: Oct. 27, 1998

[54] SKI BOOT HAVING A COMBINED CLOSURE AND HEEL-ENGAGING MEMBER

[75] Inventor: Franco Vaccari, Montebelluna, Italy

[73] Assignee: Dolomite S.p.A., Montebelluna, Italy

[21] Appl. No.: 542,658

[22] Filed: Oct. 13, 1995

Related U.S. Application Data

[63] Continuation of Ser. No. 279,346, Jul. 22, 1994, abandoned.

[30] Foreign Application Priority Data

Dec. 14, 1993 [IT] Italy ..... PD93A0240

[51] Int. Cl.[6] ..... A43B 5/04; A43B 5/16

[52] U.S. Cl. ..... 36/118.1; 36/117.8

[58] Field of Search ..... 36/117–121, 117.1, 36/118.1, 117.8, 117.6, 117.7

[56] References Cited

U.S. PATENT DOCUMENTS

| | | | |
|---|---|---|---|
| 4,280,286 | 7/1981 | Sartor | 36/105 |
| 4,447,970 | 5/1984 | Delery | 36/121 |
| 4,577,421 | 3/1986 | Sartor | 36/50.5 |
| 4,615,127 | 10/1986 | Delery | 36/117 |
| 4,624,064 | 11/1986 | Pozzebon | 36/50.5 |
| 4,719,709 | 1/1988 | Vaccari | 36/50.5 |
| 4,856,210 | 8/1989 | Delery | 36/50.5 |
| 5,063,693 | 11/1991 | Morell et al. . | |
| 5,313,720 | 5/1994 | De Bortoli et al. | 36/119 |
| 5,575,015 | 11/1996 | Paris | 36/117.1 X |

FOREIGN PATENT DOCUMENTS

| | | |
|---|---|---|
| 0286586 | 10/1988 | European Pat. Off. . |
| 0430821 | 6/1991 | European Pat. Off. . |
| 0521432 | 1/1993 | European Pat. Off. . |

*Primary Examiner*—B. Dayoan

*Attorney, Agent, or Firm*—Sughrue, Mion, Zinn, Macpeak & Seas, PLLC

[57] ABSTRACT

Sport footwear with a shell, a bootleg, and a device for clamping the heel region of the shell tight, including an eave pivoted on the shell and an anchor member which is associated slidingly with the bootleg, and a tie member between the sliding anchor member and the eave for swinging the eave into a working position in a way which is operated directly by operating the fastener for the bootleg.

14 Claims, 3 Drawing Sheets

SKI BOOT HAVING A COMBINED CLOSURE AND HEEL-ENGAGING MEMBER

This is a Continuation of application Ser. No. 08/279,346 filed Jul. 22, 1994 now abandoned.

DESCRIPTION

This invention relates to sport footwear, in particular ski boots, skating boots, and the like, being of a type which comprises:

a boot shell having a rearward region wherein a heel area included between respective lateral sides of the shell is located, a cutout extending at least partway between said lateral sides in the heel area and producing two juxtaposed flaps, a bootleg associated with the boot shell at said lateral sides, bootleg fastening means including first and second members for anchoring on the bootleg, and a closure device which can be tensioned in an adjustable manner between said anchor members, a heel area clamping device including an eave pivotable on said shell at said cutout and means for swinging said eave to a working position where it is urged toward a forward region of the shell.

BACKGROUND OF THE INVENTION

Ski boots with the above features have been known, for example, from U.S. Pat. Nos. 4,719,709 and 4,615,127.

These documents relate to ski boots of the so-called rear entrance type, having a forward bootleg and a rearward bootleg mounted on a boot shell and adapted to be clamped together using fastener means. Both documents illustrate the use of an eave which, through pressure means mounted on the rearward bootleg, is urged in the direction toward a forward portion of the shell to hold the skier's heel tightly within the shell. Among the drawbacks of this approach is that the pressure means complicate the boot construction and increase its bulk. In addition, an unskilled user is apt to neglect this adjustment, although it improves the foot retention, in the shell significantly. Not least is the fact that, with the solutions provided by these inventions, the foot is mainly retained by a thrust force, exerted by the eave on the heel, which is directed toward Achilles' sinew and the forward portion of the shell.

The underlying problem of this invention is to provide sport footwear, preferably of the forward entrance type, which is conceived, both construction-wise and functionally, to overcome all of the drawbacks with which the above-referenced prior art is beset.

SUMMARY OF INVENTION

This problem is solved according to the invention by sport footwear of the kind specified in the introduction being characterized in that said means for swinging said eave are operated directly by said bootleg fastener means.

Advantageously, said means for swinging said eave comprise at least one of said anchor members which is associated slidingly with the bootleg, and a tie member between said sliding anchor member and said eave for swinging said eave to said working position upon said bootleg fastener means being tightened.

BRIEF DESCRIPTION OF THE DRAWINGS

The invention will now be described with reference to a preferred embodiment thereof, illustrated by way of example and not of limitation in the accompanying drawings, in which.

DESCRIPTION OF THE PREFERRED EMBODIMENTS

Figure 1:
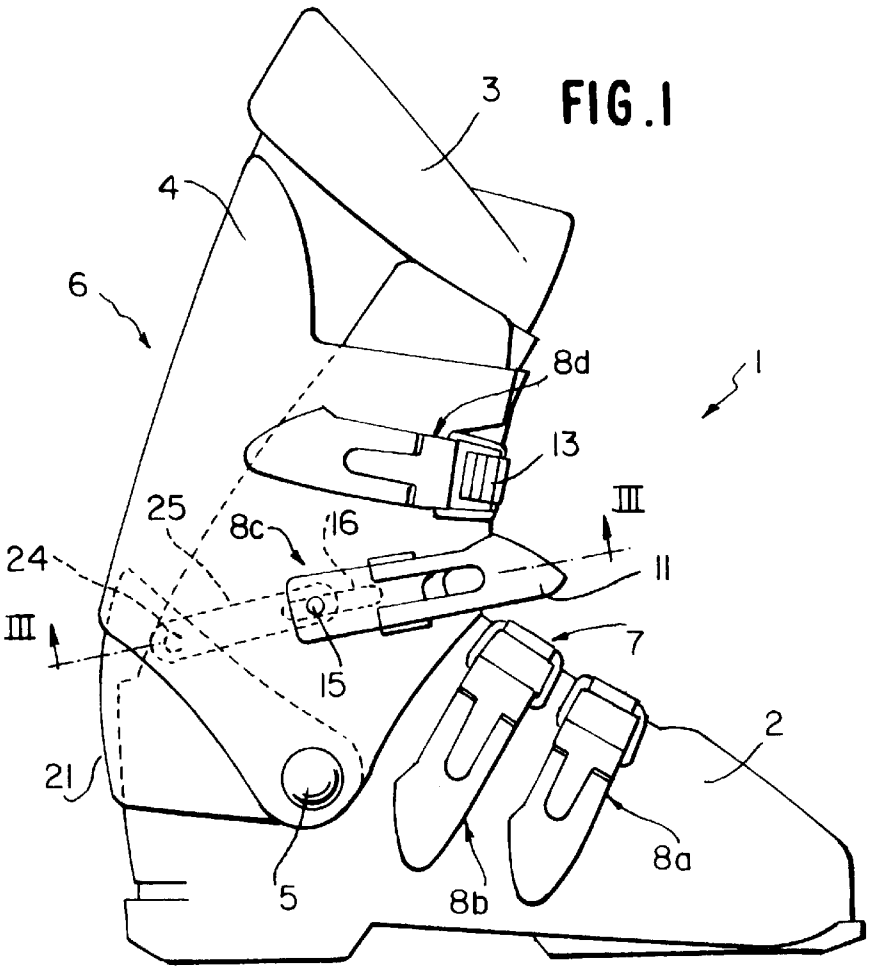
FIG. 1 is a side elevation view of a ski boot according to the invention with the fastener means for the bootleg somewhat slackened.

In the drawing figures, generally shown at 1 is a ski boot including a shell 2, an inner shoe 3, and a bootleg 4. The boot shell and bootleg are preferably plastics moldings which are hinge connected together about hinge pins 5.

The boot 1 is of the so-called forward or top entrance type. As such,. it has the shell and bootleg substantially closed in the rearward region 6 and open in the forward region 7. A typical configuration of the forward region 7 of the shell and the bootleg is one with overlapping flaps which are tightened on top of each other in an adjustable way through respective fastening devices 8*a,b,c,d*. It should be understood that the shell and/or bootleg may also have any other known configuration for forward entrance boots. The fastening devices 8*a–d* are each conmprised of a base 10 to which a lever 11 is pivoted which carries a looped tie 12. The tie 12 is swivel connected to the lever 11 into configurations which are known per se, and is engaged releasably between teeth of a rack 13, also conventional in design. The base 10 and the rack 13 form first and second anchor members, respectively, for securing the fastening device on the shell or the bootleg, whereas the lever 11 and tie 12 form a closure device which can be tensioned adjustably by appropriate selection of the teeth of the rack 12 to be engaged.

Notice that the base 10 of the fastening device 8*c* for the bootleg 4 is held to the bootleg in a limited sliding relationship by a peg 15 passed through an elongate slot 16 in the direction of the pull exerted by the fastening device 8*c* itself. The sliding movement limits are set by a condition of abutment of the peg against the two opposite longitudinal ends of the slot 16.

Figure 4:
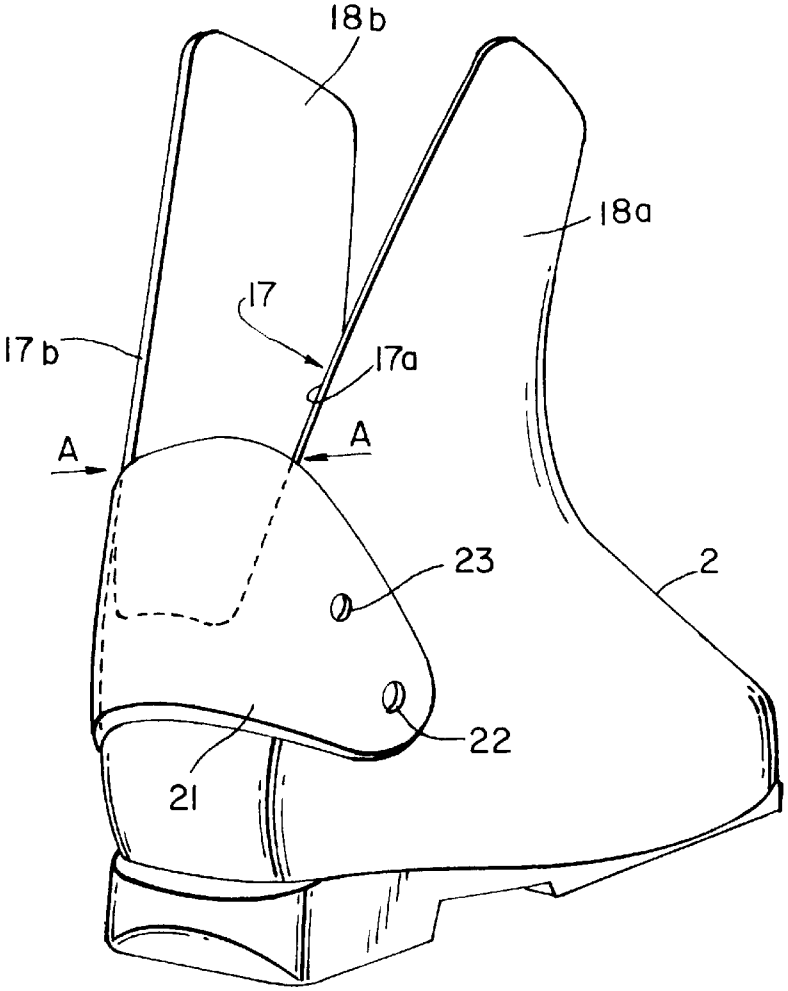
FIG. 4 is a perspective view of the shell of the boot shown in the previous Figures.
Figure 5:
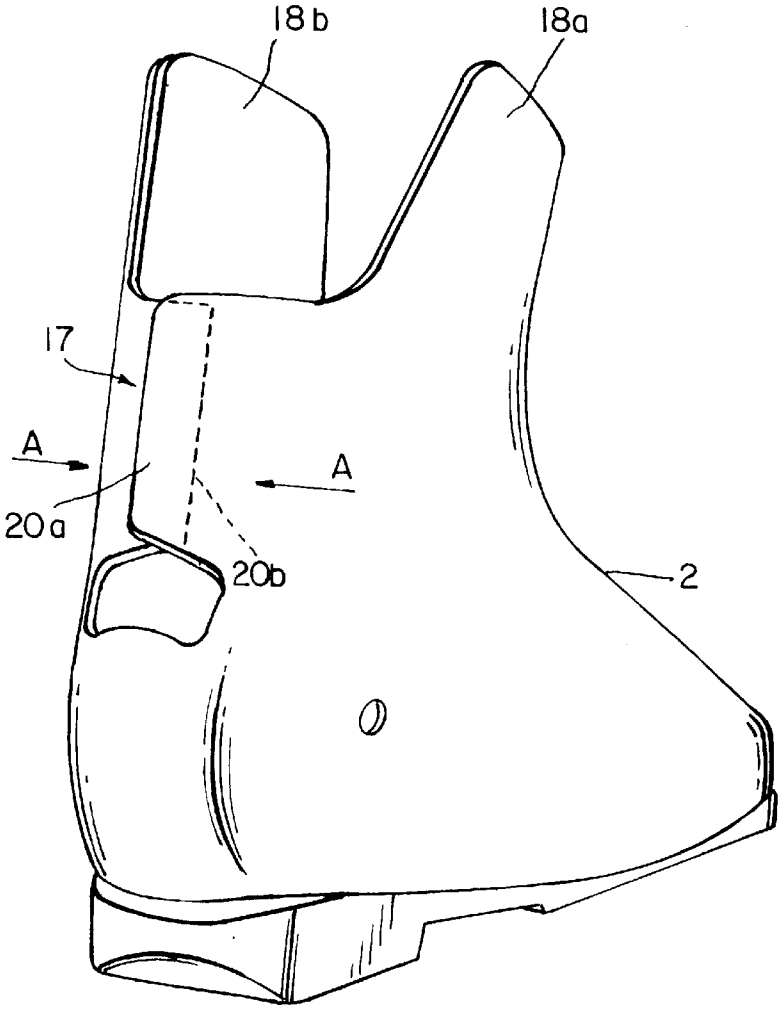
FIG. 5 is a perspective view of a modified shell of that same boot.

The rearward portion of the shell 2 is formed with a cutout or hollow 17 which bounds two opposite lateral sides 18*a,b* of the shell. Defined between said lateral sides is a heel area 19 corresponding physically to the shell area where the heel 19*a* of the foot 19*b* (FIG. 2) of a wearer of the boot 1 fits. Each lateral side has a respective flap at the location of the cutout 17; these flaps may be oppositely laid as indicated at 17*a*, 17*b* in the shell example of FIGS. 1–4 and 7, or may overlap in part or completely, as in the example of the shell shown in FIG. 5, where the overlapping portions of said flaps are denoted by 20*a*, 20*b*. The thickness and/or material of the shell at said flaps are such that the shell 2 is deformable elastically along the flap directions of movement toward and away from each other. These directions are indicated by arrows A in FIGS. 4 and 5. When the shell is adequately deformable in the directions shown, the cutout 17 may be omitted, wholly or in part.

Lastly, the boot 1 comprises a tightening device for the heel area. This device includes an eave 21 which is mounted on the shell for swinging movement between a rest position, where it is turned downwards toward the sole of the shell 2 (FIG. 1), and a working position where it is turned upwards from the shell in a direction away from the sole. The eave 21 is preferably pivoted on the shell at a location such that its pivot axis is coincident with the center of curvature of the heel contour line (broken line in FIG. 2) in the area where the eave acts on the heel. In the example shown, the eave 21 is pivoted about the same pivot pins 5 as the shell 2 and the bootleg 4; for this purpose, it is provided with a pair of holes 22. Said eave 21 also has a third hole 23 wherein one end of a tie 25 is secured, as by means of a rivet 24 or its equivalent, which has the other end attached to the peg 15 set in the base 10.

Figure 6:
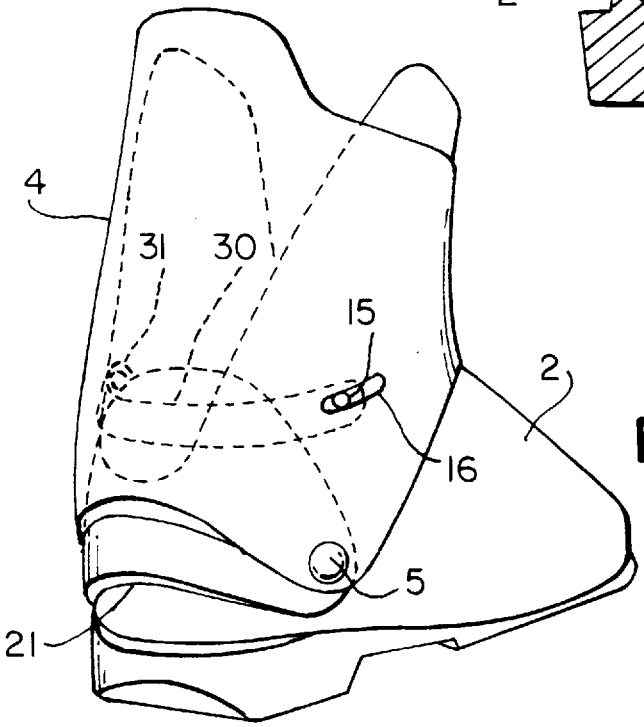
FIG. 6 is a perspective view of a modified embodiment of the invention.

In a modified embodiment shown in FIG. 6, the eave 21 is embraced by a tie 30 running between the bootleg, the eave and the shell, and having one end also connected to the peg 15 on the base 10 and the other longitudinal end 31 attached to the bootleg 4. In this way, the eave displacement for a given sliding stroke of the base is halved.

Figure 2:
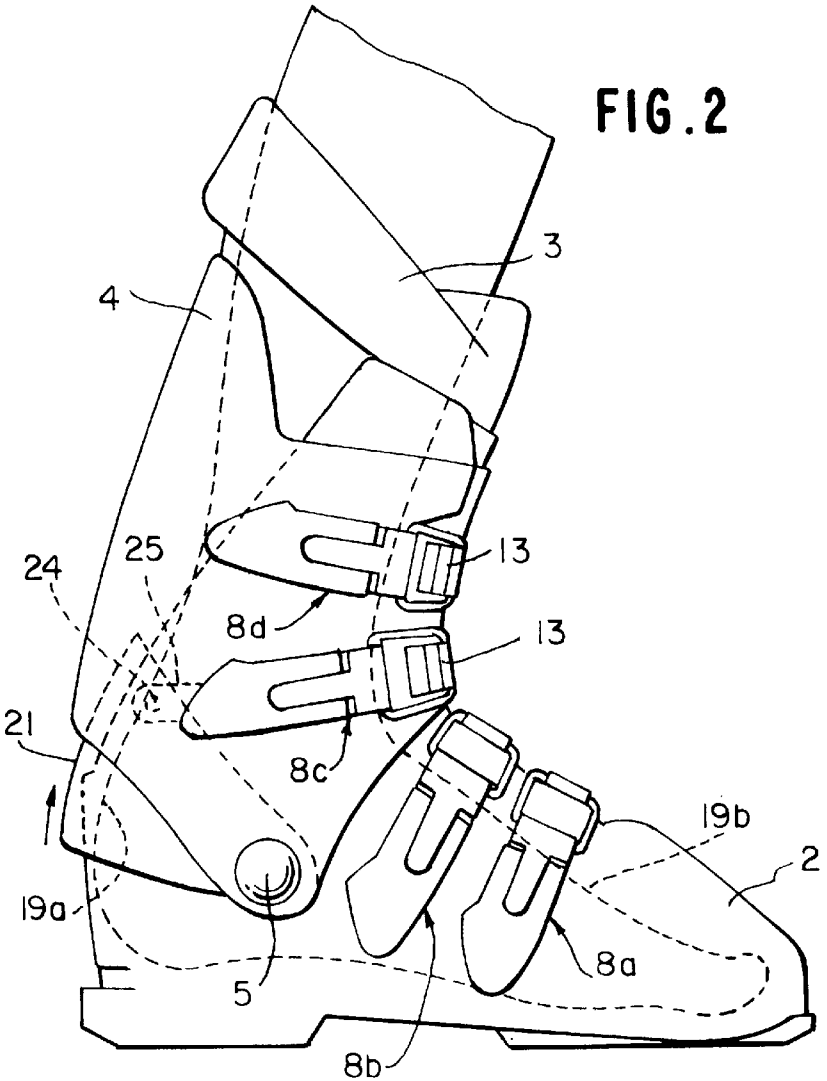
FIG. 2 is a side elevation view of the same boot with the bootleg fastened tight.
Figure 3:
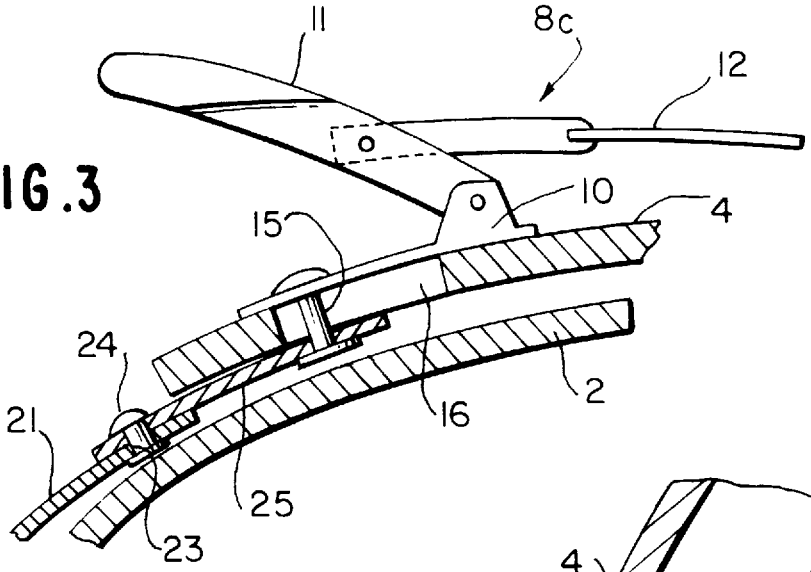
FIG. 3 is a partial sectional view taken along line III—III in FIG. 1, drawn to an enlarged scale.
Figure 7:
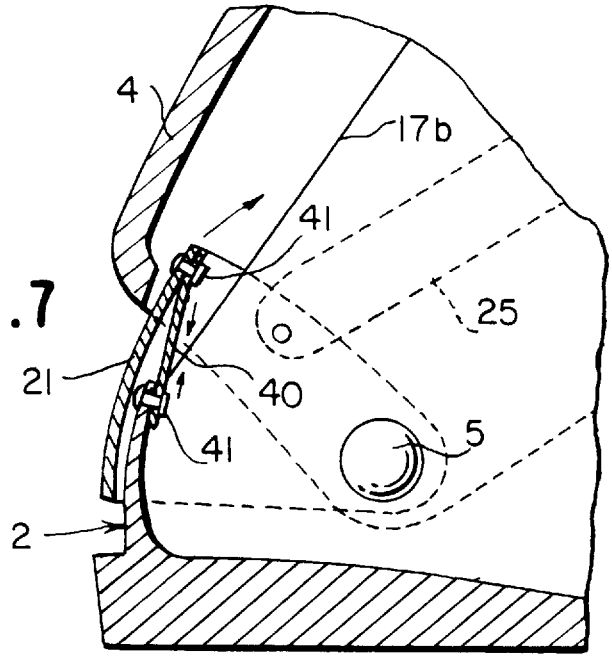
FIG. 7 is a partial sectional view through the heel area showing an eave retracting arrangement.

In a second modification shown in FIG. 7, the eave 21 is biased elastically toward the rest position in FIG. 1 by an elastic bias device 40, such as a strip of elastic rubber or the like, having opposed ends which are attached to the shell 2 and the eave 21, respectively, by means of rivets 41.

The operation of the boot 1 as regards donning it and actuating the fastener means 8*a,b,d* is quite conventional. On donning the boot, the fastening devices 8*a–d* are all fully slackened, and the base 10 of the device 8*c* is preferably shifted to a position on the bootleg whereby the pin 15 abuts against the closest end of the slot 16 to the rearward portion of the bootleg and the eave 21 is in its rest position. This setting is assisted, in the example of FIG. 7, by the elastic bias provided by the device 40 between the shell 2 and the eave 21.

After donning the boot, the fastening devices are set tight by properly turning the levers 11. In tightening the device 8*c*, a first tightening step is performed whereby the base 10 is slid on the bootleg toward the rack 10 as far as the travel limits from the slot 16 permit. During this step, the eave 21 is swung relative to the bootleg to its working position of FIG. 2. As the eave is swung away from the sole, it has a dual effect on the heel area of the shell and the wearer's foot. A first effect consists of a downwardly directed pressure on the wearer's heel being applied through the shell 2 and the inner shoe 3. This is of assistance in preventing the foot heel from rising within the inner shoe of the boot 1, thereby avoiding diminished ski control capabilities. The second, and no less important, effect consists of a gradual tightening action being applied to the shell flaps along a direction in which the lateral sides of the shell tend to be brought together, as indicated by arrows a in FIGS. 4 and 5. Thus, the shell and inner shoe become subjected to a slight compression force, and the heel area of the skier's foot is clamped sideways.

Upon the pin 15 abutting against the opposite end of the slot 16 from the previous one where the eave 21 was brought to its rest position, the base 10 can be slid no farther relative to the bootleg 4, and continued turning of the lever 11 will, besides adding to the pull on the eave 21, cause the bootleg 4 to be tightened around the skier's leg.

While it has been suggested that one anchor member only be made slidable with respect to the bootleg and that it be connected to the eave by a tie, it is also contemplated that both anchor members (base 10 and rack 13) may be slidable on the bootleg and connected to the eave by individual ties.

Thus, the invention does solve the proposed problem using an advantageously simple, inexpensive and easily operated construction. Among the principal advantages it affords are the improved clamping of the heel from the combined actions of the pressure toward Achilles' sinew and the sideways foot clamping.

I claim:

1. An article of sport footwear comprising:

a boot shell having a rearward region wherein a heel area included between respective lateral sides of the shell is located, a cutout extending at least partway between said lateral sides in the heel area to provide two opposed flaps, a bootleg associated with the boot shell at said lateral sides, said bootleg having a front opening and a rear portion continuous with opposite sides of said bootleg, bootleg fastener means including first and second anchor members on the bootleg, and a closure device which can be tensioned in an adjustable manner between said anchor members to close said front opening, a heel area clamping device including an eave pivotable on said shell at said cutout and extending at least in part between said shell and said rear portion of said bootleg and means for swinging said eave to a working position where it is urged toward a forward region of the shell, wherein said means for swinging said eave are operated directly by said bootleg fastener means, wherein said means for swinging said eave comprise at least one of said anchor members being associated slidingly with the bootleg, and a tie between said sliding anchor member and said eave for swinging said eave to said working position upon said bootleg fastener means being tightened, and wherein said sliding anchor member has limited sliding movement on said bootleg such that, upon said bootleg fastener means being tightened, a first actuation of said eave consequently of the sliding movement of said anchor member on the bootleg and a second actuation of said eave consistent with a corresponding tightening of the bootleg take place.

2. Footwear according to claim 1, wherein said eave embraces the two flaps of the shell on exterior surfaces of the two flaps.

3. Footwear according to claims 1 or 2, wherein the eave and bootleg are pivoted on the shell in the same places.

4. Footwear according to claims 1 or 2, wherein one of said anchor members is a base to which a lever of the fastener means is pivoted, said base being connected to the tie by a peg passed through a slot formed in the bootleg, said slot including opposed longitudinal ends and extending in a sliding direction of the base, said peg forming, in co-operation with the opposed longitudinal ends of the slot, means of limiting the sliding stroke of the base on the bootleg.

5. Footwear according to claims 1 or 4, wherein an elastic bias device biasing said eave to a rest position is provided between said shell and said eave.

6. An article of forward entrance sport footwear, comprising:

a boot shell having a rearward region wherein a heel area included between respective lateral sides of the shell is located;

a cutout extending at least partway between said lateral sides in the heel area to provide two opposed flaps, a bootleg associated with the boot shell at said lateral sides, said bootleg having a front opening and a rear portion continuous with opposite sides of said bootleg, a bootleg fastener including first and second anchor members and a closure device which can be tensioned in an adjustable manner between said anchor members to close said front opening, a heel area clamping device including an eave pivotable on said shell at said cutout and extending at least in part between said shell and said rear portion of said bootleg, said eave being coupled to said bootleg fastener so that operation of said bootleg fastener swings said eave into a working position where it is urged toward said front opening of said bootleg.

7. An article of footwear according to claim 6, wherein said bootleg fastener is coupled to said eave by a tie having one end attached to said bootleg fastener and another end fixedly attached to said eave.

8. An article of footwear according to claims 6 or 7, wherein at least one of said anchor members is slidingly attached to the bootleg to allow limited sliding movement on said bootleg such that during a first actuation of said bootleg fastener said eave is urged forward due to a sliding movement of said anchor member without tightening said bootleg, and during a further actuation of said bootleg fastener said eave is further urged forward with a corresponding tightening of the bootleg.

9. An article of footwear according to claim 6, wherein said eave and bootleg are pivoted on the shell in the same places.

10. An article of footwear according to claim 6, wherein one of said anchor members is a base to which a lever of the fastener means is pivoted, said base being connected to the tie by a peg passed through a slot formed in the bootleg, said slot including opposed longitudinal ends and extending in a sliding direction of the base, said peg forming, in co-operation with the opposed longitudinal ends of the slot, means of limiting the sliding stroke of the base on the bootleg.

11. An article of footwear according to claim 6, wherein an elastic bias device associated with said eave for biasing said eave to a rest position is provided.

12. A forward entrance ski boot, comprising:

a boot shell having a rearward region wherein a heel area included between respective lateral sides of the shell is located, a cutout extending at least partway between said lateral sides in the heel area to provide two opposed flaps, a bootleg associated with the boot shell at said lateral sides, said bootleg having a front opening and a rear portion continuous with opposite sides of said bootleg, a bootleg fastener including first and second anchor members anchored on the bootleg, and a closure device which can be tensioned in an adjustable manner between said anchor members for closing said front opening, a heel area clamping device including an eave pivotable on said shell at said cutout and extending at least in part between said shell and said rear portion of said bootleg and means for swinging said eave to a working position where it is urged toward a forward region of the shell, wherein means for swinging said eave are operated directly by said bootleg fastener, wherein said means for swinging said eave comprise at least one of said anchor members being associated slidingly with the bootleg, and a tie between said sliding anchor member and said eave for swinging said eave to said working position upon said bootleg, fastener means being tightened.

13. The ski boot of claim 12, wherein said sliding anchor member has limited sliding movement on said bootleg such that during a first tightening of said bootleg fastener said anchor member slides and said tie urges said eave forward without tightening said bootleg, and during a subsequent tightening of said bootleg fastener said bootleg is tightened.

14. An article of sport footwear according to claim 6, wherein said bootleg fastener is coupled to said eave by a strap connected at one end to said shell, extending about a rearwardly facing surface of said eave and connected at an opposite end to said bootleg fastener.

* * * * *